US012590516B2

(12) United States Patent
Shaw

(10) Patent No.: US 12,590,516 B2
(45) Date of Patent: Mar. 31, 2026

(54) CONTINGENCY SEALING OPTION FOR SURFACE CONTROLLED FLOW CONTROL DEVICE

(71) Applicant: Silverwell Technology Ltd, Histon (GB)

(72) Inventor: Joel David Shaw, Houston, TX (US)

(73) Assignee: Silverwell Technology Limited, Cambridge (GB)

( * ) Notice: Subject to any disclaimer, the term of this patent is extended or adjusted under 35 U.S.C. 154(b) by 0 days.

(21) Appl. No.: 18/664,053

(22) Filed: May 14, 2024

(65) Prior Publication Data

US 2025/0354464 A1 Nov. 20, 2025

(51) Int. Cl.

| | |
|---|---|
| ***E21B 43/12*** | (2006.01) |
| ***E21B 34/08*** | (2006.01) |
| ***E21B 34/10*** | (2006.01) |
| ***E21B 34/16*** | (2006.01) |

(52) U.S. Cl.

CPC ..... *E21B 43/123* (2013.01); *E21B 34/107* (2013.01); *E21B 34/08* (2013.01); *E21B 34/16* (2013.01); *E21B 2200/06* (2020.05)

(58) Field of Classification Search

CPC .... E21B 43/123; E21B 43/122; E21B 34/107; E21B 34/102; E21B 34/103; E21B 34/10; E21B 34/14; E21B 34/08; E21B 34/16; E21B 2200/06

See application file for complete search history.

(56) References Cited

U.S. PATENT DOCUMENTS

| | | | | |
|---|---|---|---|---|
| 2,347,620 A * | 4/1944 | Taylor, Jr. | F04F 1/06 417/115 |
| 2,642,889 A | 6/1953 | Cummings | |
| 2,824,525 A | 2/1958 | Mcgowen, Jr. | |
| 2,846,014 A | 8/1958 | Daffin et al. | |
| 3,011,511 A | 12/1961 | Canalizo | |
| 3,124,151 A | 3/1964 | Lilly | |
| 3,218,985 A | 11/1965 | Walton | |
| 3,311,126 A * | 3/1967 | Dudley | E21B 43/123 137/489.5 |
| 4,432,416 A | 2/1984 | Welch et al. | |
| 7,647,975 B2 | 1/2010 | Messick et al. | |

(Continued)

OTHER PUBLICATIONS

International Search Report and Written Opinion issued in International Application No. PCT/EP2025/063201; Report mail date Jul. 2, 2025; pp. 1-13.

*Primary Examiner* — George S Gray

(74) *Attorney, Agent, or Firm* — Bracewell LLP; Keith R. Derrington

(57) ABSTRACT

A contingency valve provides redundancy to a surface controlled flow control valve for blocking flow into production tubing from a surrounding annulus when the surface controlled flow control valve is not operational. The surface controlled flow control valve and the contingency valve are disposed in an eccentric portion of the production tubing, and include valve members that are selectively disposed in a path of the flow within a sidewall of the production tubing. Valve members in the contingency valve are urged into the flow path by pressurizing hydraulic fluid downhole or by using a shifting tool. The types of surface controlled flow control valves include an inflow control device, an inflow control valve, and a gas lift valve.

12 Claims, 14 Drawing Sheets

(56) References Cited

U.S. PATENT DOCUMENTS

| | | | | |
|---|---|---|---|---|
| 10,480,284 | B2 * | 11/2019 | Watson | E21B 34/066 |
| 10,584,563 | B2 | 3/2020 | Richards et al. | |
| 10,954,762 | B2 | 3/2021 | Patel | |
| 2006/0137881 | A1 | 6/2006 | Schmidt et al. | |
| 2007/0095533 | A1 * | 5/2007 | Rogers | E21B 33/14 166/285 |
| 2018/0149002 | A1 * | 5/2018 | Murdoch | E21B 47/06 |
| 2021/0293123 | A1 * | 9/2021 | Watson | E21B 43/12 |

* cited by examiner

CONTINGENCY SEALING OPTION FOR SURFACE CONTROLLED FLOW CONTROL DEVICE

BACKGROUND OF THE INVENTION

1. Field of Invention

The present disclosure relates to contingent sealing of a surface controlled flow control device.

2. Description of Prior Art

Wells for extracting hydrocarbons from subterranean formations commonly include a string of production tubing deployed in the well for directing fluid to surface that is extracted from the formation. These wells are usually lined with casing, which is perforated at depths where the hydrocarbons are trapped within the formation. Packers are generally placed in an annulus between the tubing and casing proximate these depths to prevent the produced fluid from flowing uphole in the annulus. The fluid enters the production tubing through various types of valves, that include inflow control devices and inflow control valves. Gas lift valves are another type of valve that allow communication through the walls of the production tubing and between the annulus and production tubing bore. Gas lift valves are part of a gas lift system used for assisting with the production of liquid from inside a well having insufficient pressure to drive the liquid to surface. Gas lift systems inject lift into the annulus, and selectively inject the lift gas into a column of liquid in the tubing to reduce static head pressure in the column, so that the formation pressure is sufficient to push the liquid and other fluids inside the production tubing to surface.

Failure of these valves can create numerous problems that affect wellbore production. When these devices fail closed, recovery of hydrocarbons is prevented by either not allowing hydrocarbons into the tubing or if formation pressure is inadequate to force fluid to surface without assist. Fail open valves also create issues by potentially allowing undesirable fluids (i.e., water) or higher pressure fluids into the tubing, too much lift gas that blocks an inflow of produced fluid, lift gas injected at the wrong depth or injecting at more than one depth. As these valves are coupled to production tubing, corrective action usually requires removal of the production tubing, which is costly and time consuming.

SUMMARY OF THE INVENTION

An example contingency method in a wellbore is disclosed, which includes deploying a tool inside a bore of production tubing that is disposed in a wellbore, a surface controlled flow control valve ("SCFCV") coupled to the production tubing, the SCFCV having a valve member that is selectively moveable in and out of a flow path that extends between an annulus circumscribing the production tubing and the bore, positioning the tool proximate a contingency system in the production tubing, the contingency system having a plenum in a sidewall of the production tubing and a contingency valve moveably disposed in the plenum, and blocking fluid communication along a portion of the flow path by urging the contingency valve inside the plenum to a location that is adjacent a side port formed in the sidewall of the production tubing. The method further optionally includes pressurizing the plenum on a side of the contingency valve opposite the SCFCV, and alternatively, pressurizing the plenum on a side of the contingency valve opposite the SCFCV involves pumping fluid from a reservoir inside the tool into a contingency port formed through an inner sidewall of the production tubing bore and which is in communication with the plenum. Further in this alternative, communication between the contingency port and the plenum is through a fluid line that extends axially along the production tubing. In an embodiment, pressurizing the plenum on a side of the contingency valve opposite the SCFCV involves urging fluid from a chamber into the plenum by biasing a sleeve into the chamber, where an inner diameter of the sleeve is optionally equal to or greater than an inner diameter of the bore. In embodiments, the SCFCV is an interval control valve, an inflow control device, or a gas lift valve. In alternative in which the SCFCV is a gas lift valve, the method further includes installing a contingency insert into the plenum, the contingency insert having an injection pressure operated valve. The method optionally includes bleeding fluid inside the plenum between the contingency valve and the SCFCV through a bleed plug coupled with the contingency valve. In an alternative, the method also includes monitoring the operational condition of the SCFCV.

Also disclosed herein is an example of a contingency system for use in a wellbore, which includes a plenum formed in a sidewall of production tubing disposed in the wellbore and having a surface controlled flow control valve ("SCFCV") coupled to the production tubing, the SCFCV having a valve member that is selectively moveable in and out of a flow path that extends between an annulus circumscribing the production tubing, a downhole tool deployable into a bore inside the production tubing and in selective engagement with an inner surface of the production tubing, a contingency valve disposed in the plenum, and an activation portion of the plenum on a side of the contingency valve opposite the SCFCV, which is configured to be selectively sealed, so that when the activation portion is pressurized, the contingency valve is moved into the flow path to define a barrier to fluid communication between the plenum and the bore. In an embodiment of the system, the downhole tool includes a fluid reservoir and a pump having an inlet connected to the fluid reservoir and an outlet in selective communication with the activation portion through a contingency port formed in a sidewall of the production tubing. In one embodiment, the activation portion includes a fluid line that extends axially along a length of the production tubing between the contingency port and the contingency valve. The system further optionally includes a sleeve slidably moveable axially within the production tubing, in a further alternative, the sleeve has a ridge that interfaces with the activation portion, so that when the sleeve is moved axially with respect to the production tubing, the ridge is urged against fluid in the activation portion to create a force that moves the contingency valve into the flow path. The sleeve optionally is coupled to the contingency valve, so that when the sleeve is moved axially with respect to the production tubing the contingency valve is moved into the flow path. A bleed plug is optionally included on an end of the contingency valve proximate the SCFCV, Examples of the SCFCV are an interval control valve, an inflow control device, and a gas lift valve. In an embodiment, communication between the plenum and the annulus is through an inlet port, and communication between the plenum and the bore is through a side port, and the contingency valve includes a carrier, a shoulder on an end of the carrier, a spring in the carrier, and a valve member biased against the shoulder by the spring to form a barrier to flow in a direction from the side port to the inlet port, and in an alternative, a pedestal is in the plenum, and so that when the carrier is moved within the plenum into contact with a side of the valve member facing the side port by a pressure differential between the annulus and the bore, the shoulder is biased against the valve member to form a flow barrier between the side port and the inlet port.

BRIEF DESCRIPTION OF DRAWINGS

Some of the features and benefits of the present invention having been stated, others will become apparent as the description proceeds when taken in conjunction with the accompanying drawings, in which.

Figure 1A:
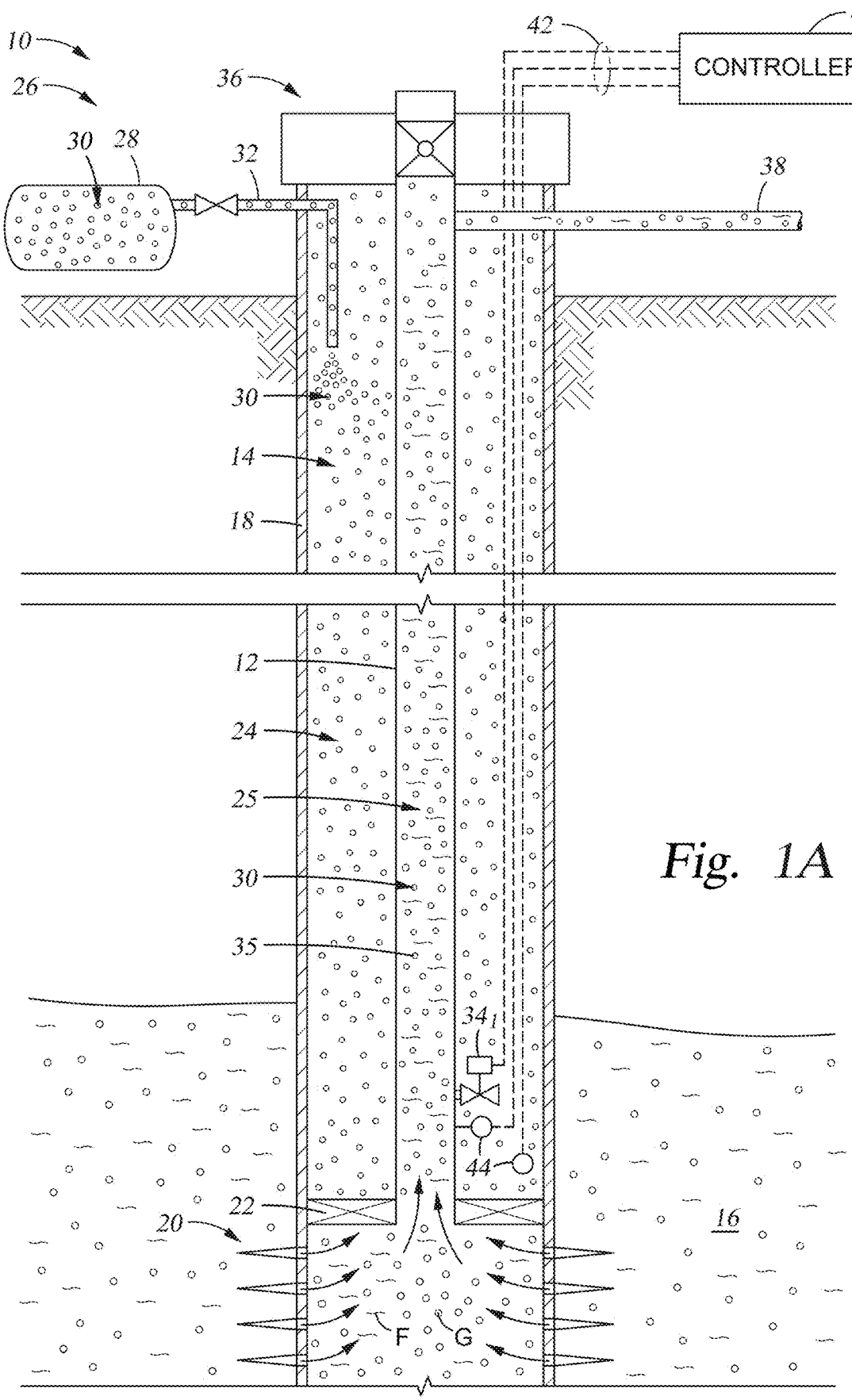
FIG. 1A is a side partial sectional view of an example of a well having a surface controlled flow control device.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Shown in a side sectional view in FIG. 1 is an example of a well system 10, which includes a string of production tubing 12 installed within a wellbore 14 that intersects a subterranean formation 16. The wellbore 14 is lined with casing 18 that has perforations 20 shown projecting radially outward from the wellbore 14 into the surrounding formation 16. In this example, the perforations 20 provide a pathway for fluid F to flow into the wellbore 14 from the formation 16. In the example shown the fluid F is made up primarily of liquid with some small bubbles of gas G mixed within. A packer 22 circumscribes a downhole end of tubing 12 to block the fluid F from flowing into an annulus 24 between the tubing 12 and casing 18, and instead directs the fluid F to a bore 25 in the production tubing 12.

The well system 10 includes a lift gas system 26 for assisting the flow of the fluid F uphole within the bore 25 of production tubing 12. An example of a lift gas source 28 is shown on the surface, embodiments of which include an adjacent well, a pipeline, or a vessel. Lift gas source 28 provides lift gas 30, which is shown being injected into the wellbore 14 through an injection line 32. Lift gas 30 inside injection line 32 is at a designated pressure so that the lift gas 30 is forced downhole within annulus 24 to a surface controlled flow control valve ("SCFCV") $\mathbf{34}_1$ shown mounted on the production tubing 12. SCFCV $\mathbf{34}_1$ is intermittently opened to allow the lift gas 30 into the bore 25 of production tubing 12, once in the bore 25, bubbles 35 of lift gas 30 are formed inside the fluid F. The lower density bubbles 35 reduce the density of the fluid F to assist the flow of fluid F uphole inside bore 25 and to a wellhead assembly 36 shown mounted over the wellbore 14 and connected to an end of production tubing 12. Inside wellhead assembly 36, the fluid F is directed to a production line 38 shown attached to a lateral side of wellhead assembly 36. Inside production line 38, fluid F is carried to a location that is offsite for transportation or to a processing facility (not shown). In the example of FIG. 1A, a controller 40 is schematically illustrated outside of wellbore 14 and in signal communication with the SCFCV $\mathbf{34}_1$ via communication means 42. Examples of communication means 42 include electrically conducting wire, fiber optics, and wireless, such as telemetry. Further optionally included are sensors 44 that are in temperature and pressure communication with annulus 24 and/or bore 25, and which transmit downhole conditions to controller 40 via communication means 42. A specific example of SCFCV $\mathbf{34}_1$ is what is commonly referred to as a gas lift valve, one example of which unit is described in Wygnanski, U.S. Pat. No. 8,925,638, and which is incorporated by reference herein its entirety and for all purposes.

Figure 1B:
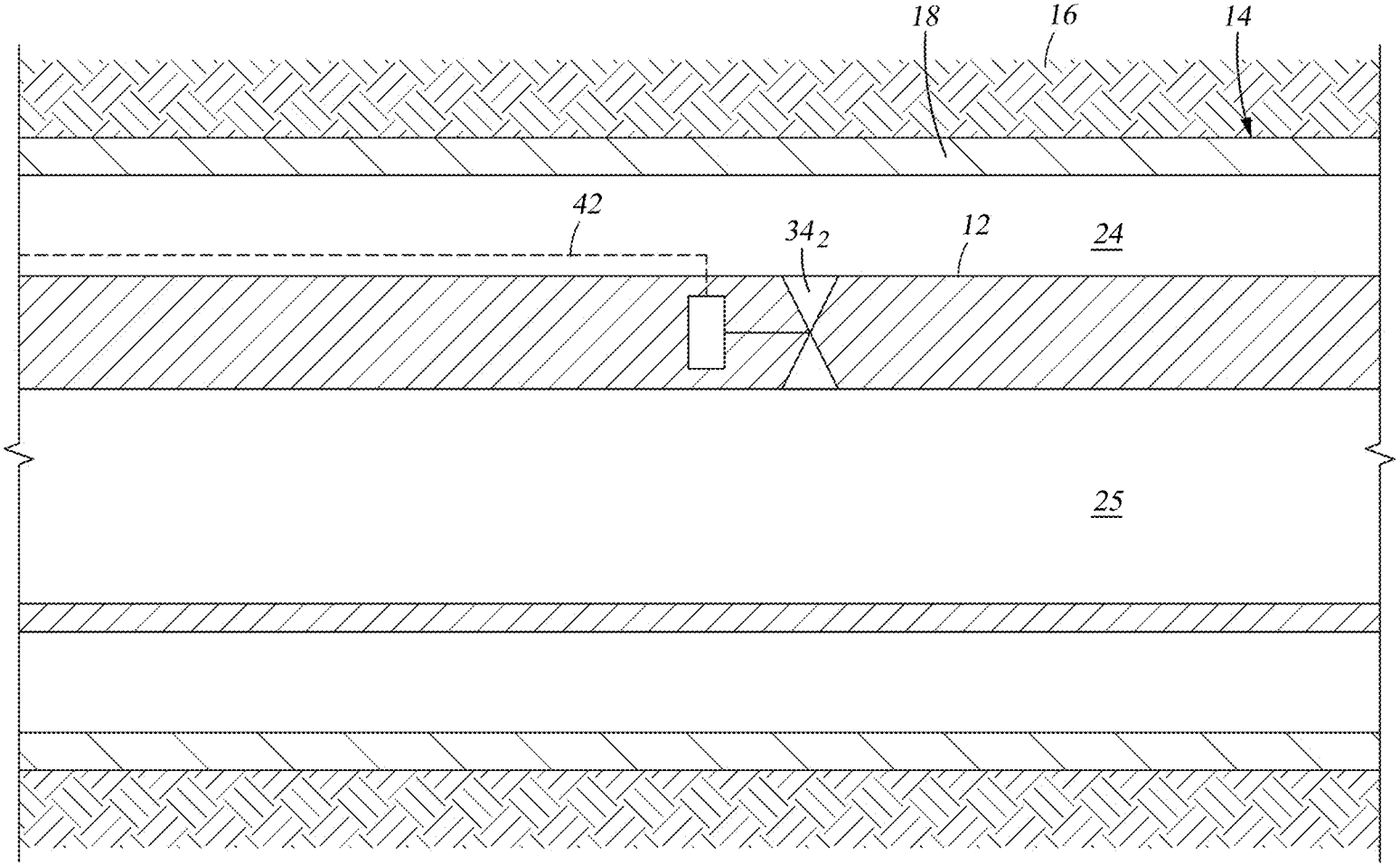
FIG. 1B is a side partial sectional view of the well of FIG. 1A having another surface controlled flow control device in a deviated portion of the well.

Another example of a surface controlled flow control valve $\mathbf{34}_2$ is shown in a side sectional view in FIG. 1B. In this example, the valve $\mathbf{34}_2$ is in a deviated or horizontal section of wellbore 14 and mounted in a sidewall of the production tubing 12, and in a section of the tubing 12 having an eccentric portion. In an example shown, the valve $\mathbf{34}_2$ operates in response to command signals received that have been transmitted from surface via communication means 42. In response to the command signals, the SCFCV $\mathbf{34}_2$ is moved into an opened and/or closed configuration to allow or block fluid communication between the annulus 24 and bore 25. Specific examples of SCFCV $\mathbf{34}_2$ include an interval control valve and/or a circulation valve.

Illustrated in a side sectional view in FIGS. 2A through 2D is a non-limiting example of remediation efforts when SCFCV $34_{1,2}$ is in a non-operational state, and which are examples of contingency operations taken to substitute for the sealing functions performed by SCFCV $34_{1,2}$. As described in more detail below, when in an operational state, SCFCV $34_{1,2}$ is responsive to command signals to selectively block communication between annulus 24 and bore 25, and when in a non-operational state, SCFCV $34_{1,2}$ is not responsive to command signals. In this example, SCFCV $34_{1,2}$ is disposed in a plenum 48 formed in eccentric portion 46 of production tubing 12. Plenum 48 is a cavity like opening formed lengthwise within the sidewalls of tubing 12. An inlet port 50 is shown in a wall of production tubing 12 that provides communication between plenum 48 and annulus 24. An outer sidewall 51 is defined in the wall of the production tubing 12 shown radially between plenum 48 and annulus 24. A side port 52 is formed radially through wall of tubing 12. Also shown is an inner sidewall 53 defined radially between plenum and bore 25, in the example shown inlet port 50 intersects outer sidewall 51 and side port 52 intersects inner sidewall 53. Annulus 24 and bore 25 are in selective communication along a flow path P that extends into the plenum 48 from the annulus 24 across inlet port 50, and from plenum 48 into bore 25 through side port 52. A contingency valve 54 is in the plenum 48 shown spaced axially away from valve $34_{1,2}$, in an example, contingency valve 54 is a generally cylindrical member, and in alternatives has a length that is substantially parallel to axis $A_{25}$ (FIG. 2A) of bore 25, and width that is transverse to the length, which circumscribes a portion, or all of, axis $A_{25}$. Contingency valve 54 is shown releasably coupled to tubing 12 by a shear pin 56 that extends between the inner and outer sidewalls of the tubing 12 and radially intersects the valve 54 between. A contingency port 58 is formed radially through the inner sidewall 53 of tubing 12 at a location spaced axially away from side port 52 and on a side of contingency valve 54 opposite the surface control valve $34_{1,2}$. For purposes of discussion herein, the contingency valve 54, shear pin 56 and contingency port 58 make up a contingency system 59 for correcting downhole anomalies when the valve $34_{1,2}$ is in a non-operational state. System 59 includes a profile 60, which is shown as a recess formed into the inner surface of the production tubing 12 that circumscribes bore 25; and which creates an enlarged diameter portion of the bore 25. In examples, the profile 60 is strategically formed a set distance from the contingency port 58.

SCFCV $34_{1,2}$ is shown having a piston 62 that connects to an actuator 64 by a shaft 66, selective operation of actuator 64 strategically positions shaft 66 to place piston 62 axially out into plenum 48 at locations that fully block the flow path between ports 50, 52, partially block the flow path, or draw the piston 62 out of the flow path so that flow between annulus 24 and bore 25 is unimpeded. An example of SCFCV $34_{1,2}$ being in an operational state, is that the SCFCV $34_{1,2}$ is selectively opened and closed in response to command signals from surface transmitted via communication means 42 (FIG. 1A) to place piston 62 in a designated position. An example of the SCFCV $34_{1,2}$ being in a non-operational state is that the SCFCV $34_{1,2}$ remains in a fully open/closed or partially open/closed configuration, and is not responsive to command signals from surface via communication means 42.

Figure 2A:
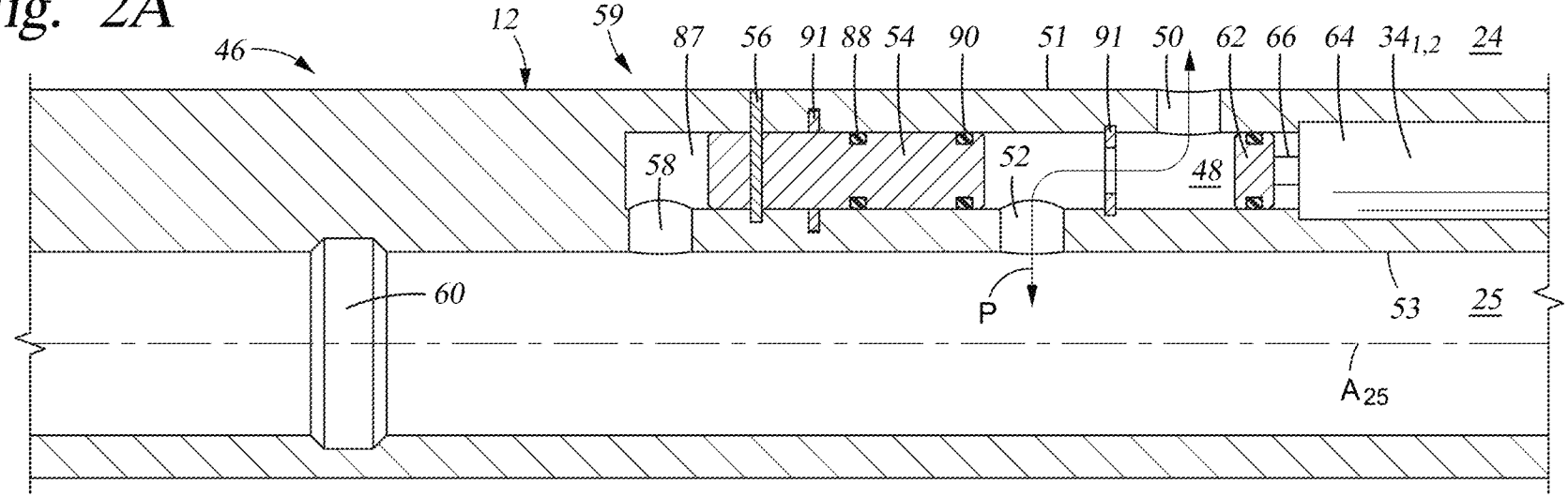
FIGS. 2A-2D are side partial sectional view of an example of conducting a contingency operation on the surface controlled flow control valves of FIGS. 1A and 1B.
Figure 2B:
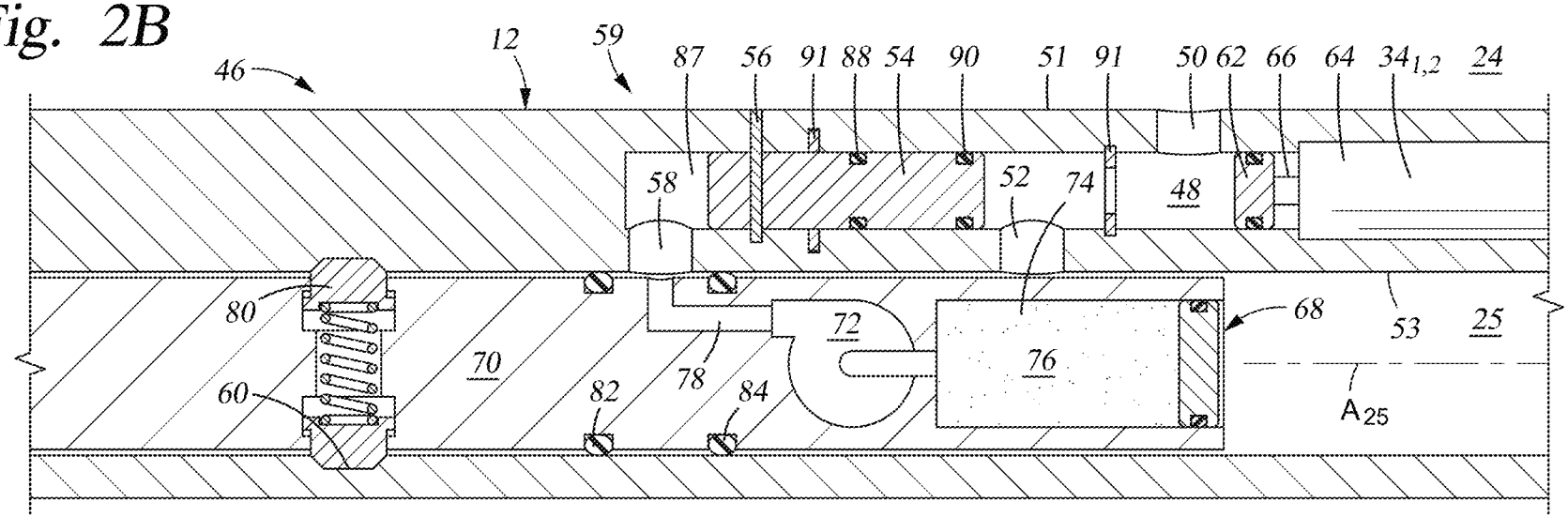

Referring now to FIG. 2B, shown is an example contingency step for remediating non-operation of SCFCV $34_{1,2}$, which includes inserting a downhole tool 68 into the bore 25 of production tubing 12. Downhole tool 68 includes an elongated body 70 having a pump 72, a reservoir 74 connected to an inlet to the pump 72, and a fluid 76 within reservoir 74. A discharge line 78 extends from an outlet of pump 72 and intersects a sidewall of body 70. A latch 80 on body 70 is engaged with profile 60. In the example shown, the distance between latch 80 and outlet of the discharge line 78 is substantially equal to a distance between contingency port 58 and profile 60. An advantage of equating these distances is that by engaging profile 60 with latch 80, fluid 76 being discharged from downhole tool 68 is directed into the contingency port 58. Seals 82, 84, which are shown as O-ring seals circumscribing body 70 on opposing sides of where the discharge line 78 exits body 70, form a sealed space between the discharge of line 78 and contingency port 58 to prevent fluid 76 from leaking into the bore 25.

Figure 2C:
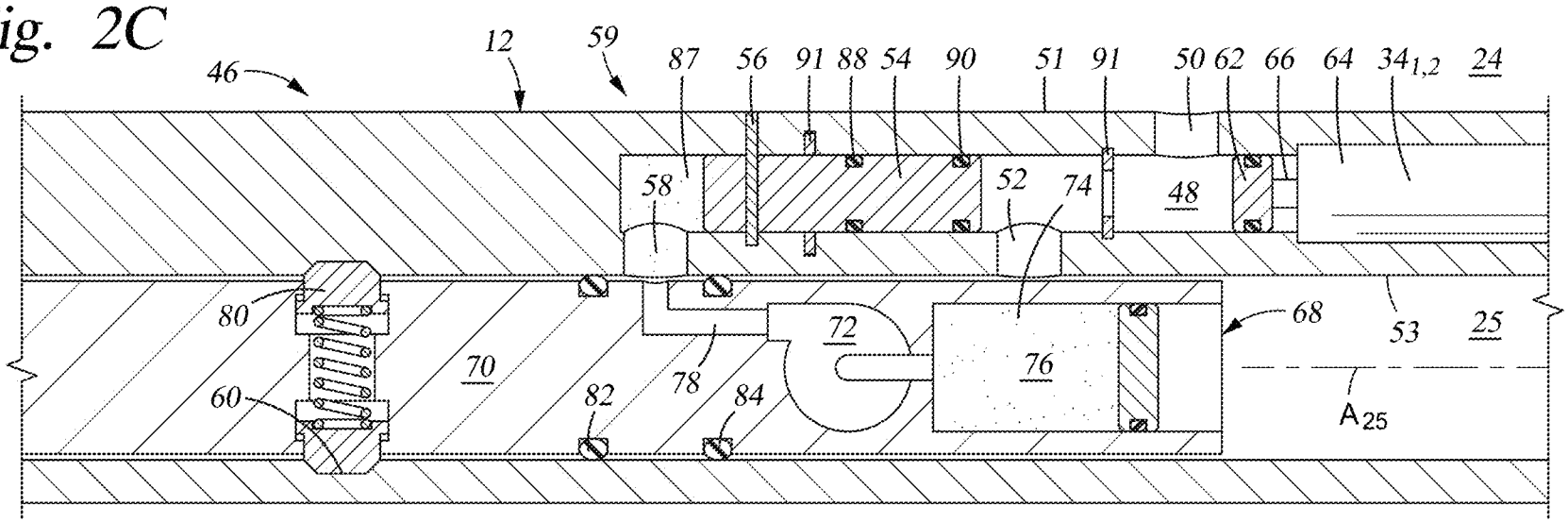
Figure 2D:
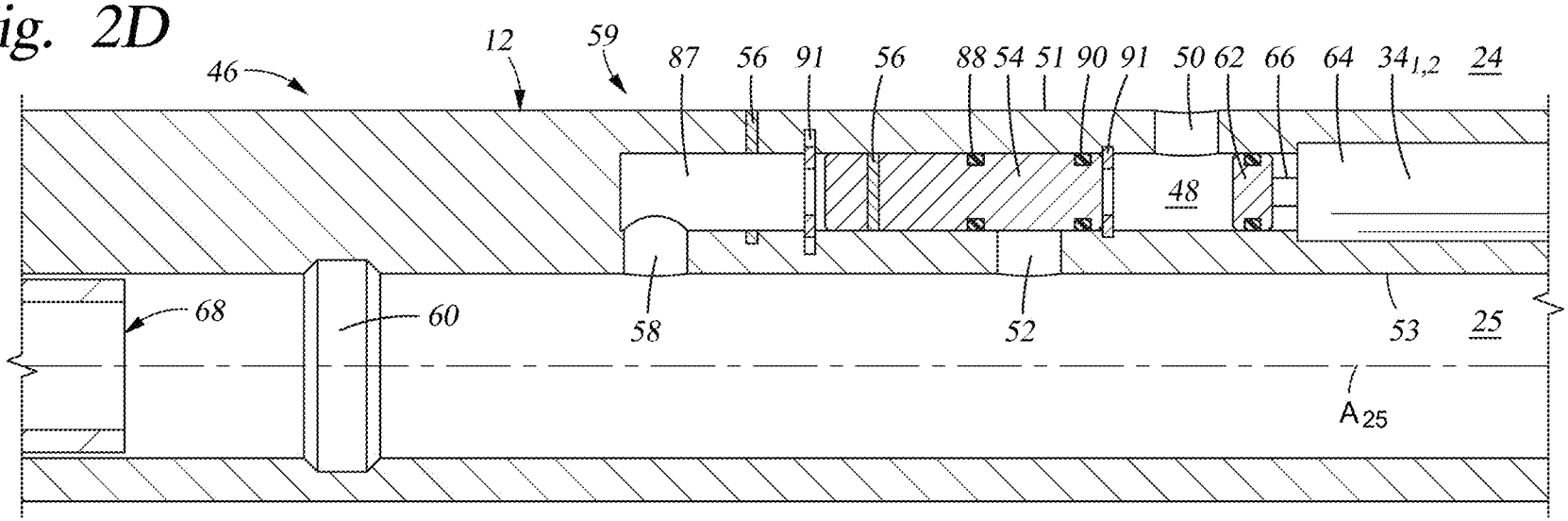

A subsequent contingency step shows in FIG. 2C that activating pump 72 draws fluid 76 from within reservoir 74, directs pressurized fluid 76 into the discharge line 78, where the fluid 76 is routed through contingency port 58 into a portion of plenum 48 on an uphole side of contingency valve 54, which is opposite valve $34_{1,2}$. For the purposes of discussion herein, this portion of the plenum 48 (on a side of contingency valve 54 opposite valve $34_{1,2}$) is referred to as an activation portion 87. Continued pressurization of activation portion 87 by operation of pump 72 exerts a force on an end of the contingency valve 54 in a direction towards the valve $34_{1,2}$. With increasing pressure, the force exerted onto the side of the contingency valve 54 exceeds a yield strength of shear pin 56, which as shown in FIG. 2D, causes shear pin 56 to fracture in response to the force from the pressurized fluid 76. In FIG. 2D, fracturing shear pin 56 decouples contingency valve 54 from the production tubing 12, and the pressurized fluid 76 on the uphole side of the contingency valve axially shifts the contingency valve 54 within plenum from its location in FIG. 2C to a location adjacent the side port 52. When adjacent the side port 52, the contingency valve 54 blocks fluid communication between side port 52 and plenum 48. O-ring seals 88, 90 circumscribe contingency valve 54 on opposing sides of the side port 52. The location of contingency valve 54, and strategic locations of O-ring seals 88, 90 block communication between the annulus 24 and bore 25. Further included with contingency system 59 are clips 91 shown formed within the inner sidewall 53 and which project into plenum 48 on opposing axial ends of contingency valve 54. Clips 91 provide backstops for the contingency valve 54 to maintain the contingency valve 54 in blocking location adjacent the side port 52 by interfering with movement of the valve 54 past the clips 91. With contingency valve 54 in place to block communication between annulus 24 and bore 25 and provide contingent sealing when the valve $34_{1,2}$ is in the non-operational state, the tool 68 is shown being removed from within bore 25. The contingency valve 54 of FIGS. 2A-2D remains in the passageway or flow path P, which provides advantages of not reducing a diameter of bore 25. Alternatives to downhole tool 68 include coiled tubing, a coiled tubing straddle assembly, inflatable packers, and pressure setting tools, such as the CPST Pressure Setting Tool, available from Schlumberger (slb.com) and the Model E-4™ wireline pressure setting assembly (WLPSA™) available from the Baker Hughes Company (https://www.bakerhughes.com). In this alternative, the charge for setting a plug downhole can be used directly (or indirectly such as via a chamber) to build pressure and perform actuation as described herein in conjunction with a contingency operation.

Figure 3:
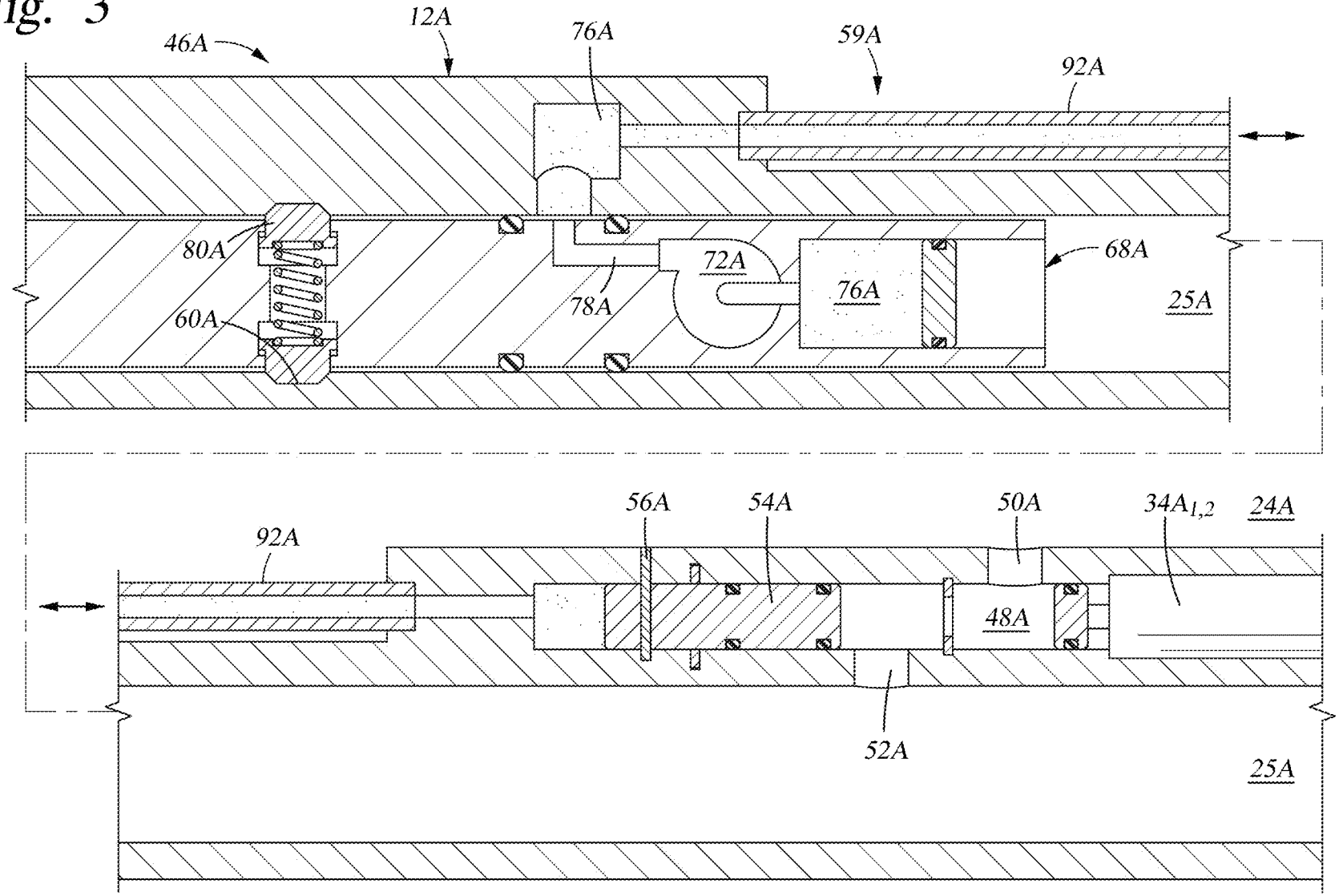
FIG. 3 is a side sectional view of an alternate example of the contingency operation of FIGS. 2A-2D.

Shown in a side sectional view in FIG. 3 is an alternate embodiment of a contingency system 59A. In this example, downhole tool 68A is located within bore 25A by interaction between latch 80A and profile 60A so that fluid 76A being discharged into line 78A and into plenum 48A is directed through a fluid line 92A and to the uphole side of the contingency valve 54A. In the same manner as discussed above, continued pressurization of fluid 76A with pump 72A fractures the shear pin 56A so that contingency valve 54A is moved into the flow path to block communication between the inlet port 50A and side port 52A.

Figure 4A:
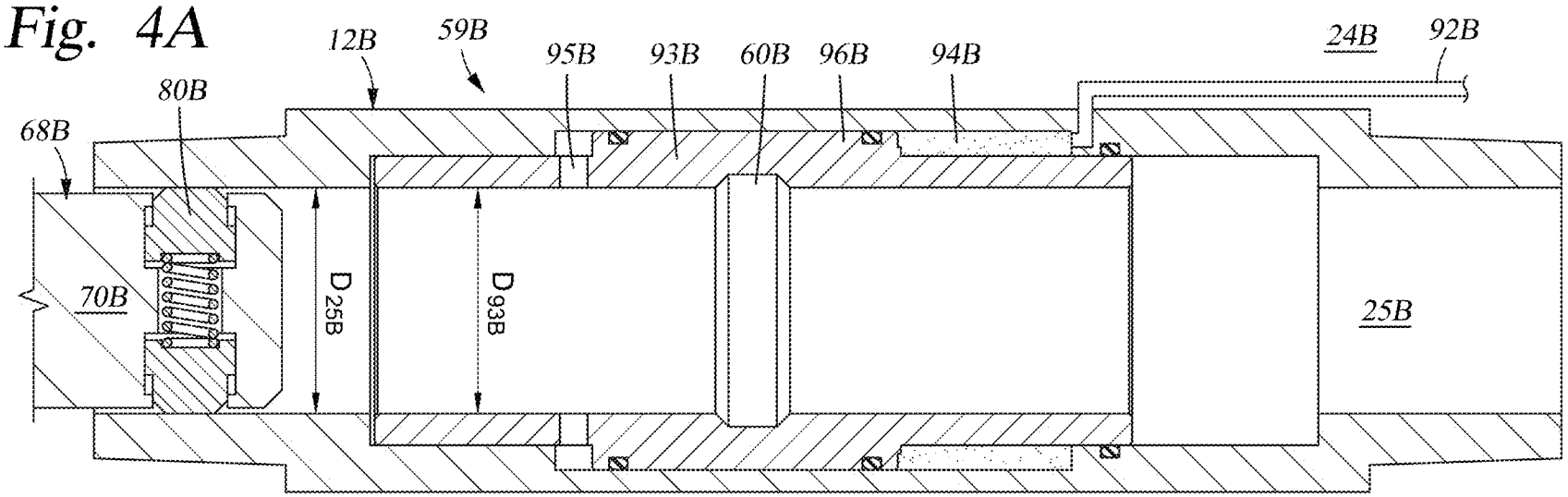
FIGS. 4A, 4B, 5A, 5B, and 6A-6D are side partial sectional views of an example of conducting a contingency operation on alternate embodiments of the surface controlled flow control valves of FIGS. 1A and 1B.
Figure 4B:
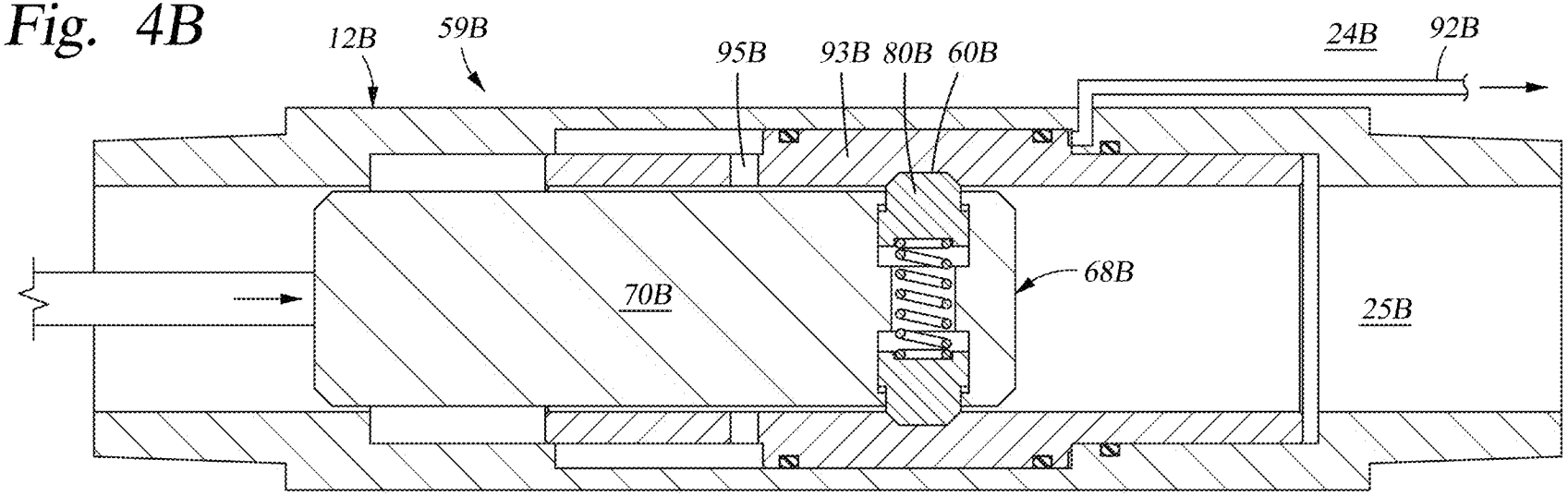

Shown in FIGS. 4A and 4B is an example of another alternate embodiment of a contingency system 59B which includes a sleeve 93B coaxially disposed within the production tubing 12B, and which is axially moveable within. Further shown is that a diameter $D_{25B}$, which is the inner diameter of bore 25B, is equal to or less than a diameter $D_{93B}$ which is the inner diameter of sleeve 93B. This is accomplished by disposing the sleeve 93B in enlarged diameter portions of the production tubing 12B, and an advantage thereof is that sleeve 93B does not reduce the diameter of bore 25B and does not create a restriction to equipment (not shown) passing through the tubing 12B. Referring specifically to FIG. 4A, sleeve 93B is shown positioned adjacent a chamber 94B formed within a sidewall of production tubing 12B. Sleeve 93B includes a radial slot 95B that extends through the sidewall of sleeve 93B. Formed along an outer surface of sleeve 93B is a ridge 96B, defined where an outer diameter of sleeve 93B projects radially outward. The ridge 96B abuts the chamber 94B, and as shown in FIG. 4B sliding sleeve 93B axially in a direction towards chamber 94B abuts ridge 96B against chamber 94B to urge fluid within chamber 94B through line 92B and to an uphole side of the contingent valve 54A (FIG. 3) for moving the contingent valve 54A into a position for blocking flow from the annulus 24B into the bore 25B. In the example of FIGS. 4A and 4B, the downhole tool 68B includes a latch 80B, which as shown in FIG. 4B, engages the profile 60B within sleeve 93B. Manipulating the body 70B to provide a downhole urging force, shifts the sleeve 93B into the position of FIG. 4B.

Figure 5A:
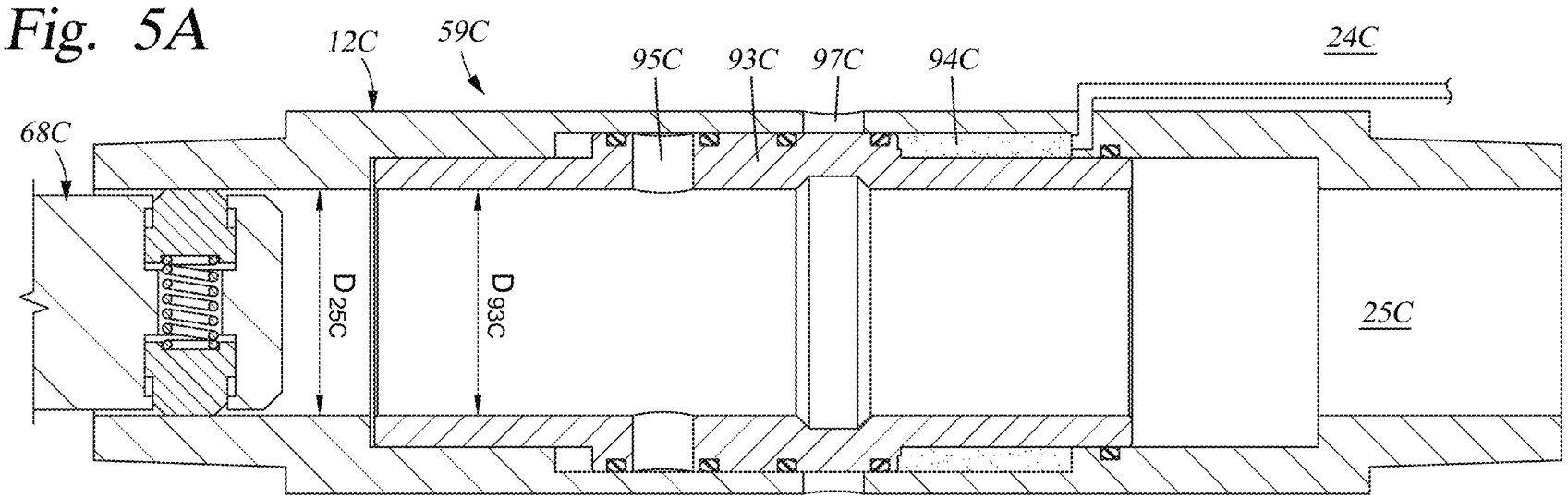
Figure 5B:
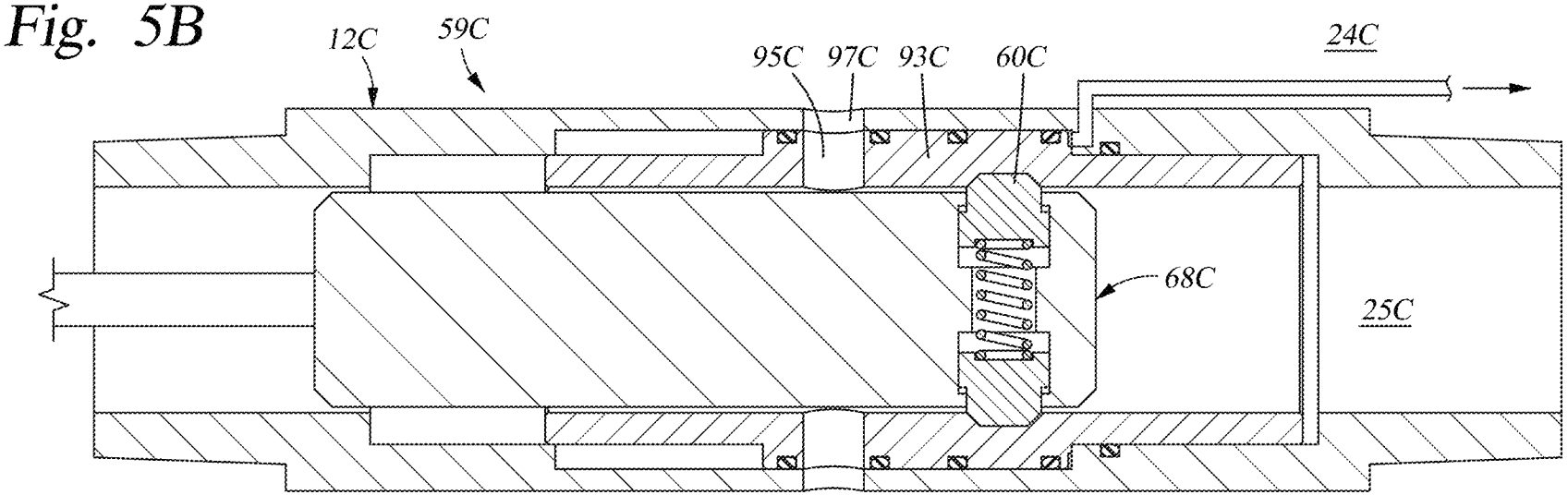

Another embodiment of a contingency system 59C is shown in a side sectional view in FIGS. 5A and 5B. In this example, sleeve 93C (which is similar to sleeve 93B of FIGS. 4A and 4B) is included shown having an inner diameter $D_{93C}$ that is equal to or greater than a diameter $D_{25C}$ of bore 25C. Similar to the example of FIGS. 4A and 4B, fluid is evacuated from chamber 94C by axial movement of sleeve 93C, which exerts a force against uphole side of the contingent valve 54A (FIG. 3) for moving the contingent valve 54A into a position for blocking flow from the annulus 24C into the bore 25C. Actuating downhole tool 68C to axially move sleeve 93C into the position illustrated in FIG. 5B, registers port 95C with a port formed radially through a sidewall of the production tubing 12C. Optional port 97C allows the intervention mechanism to provide an opening in the tubing 12 if the SCFCV (not shown) is plugged, stuck shut, or stuck partially closed. In examples, sleeves 93B, 93C are tubular and fully circumscribe bore 25B, 25C, and optionally are made up of solid segments attached by connecting structure, and where the combination of the segments and connecting structure circumscribe the bore 25B, 25C.

Figure 6A:
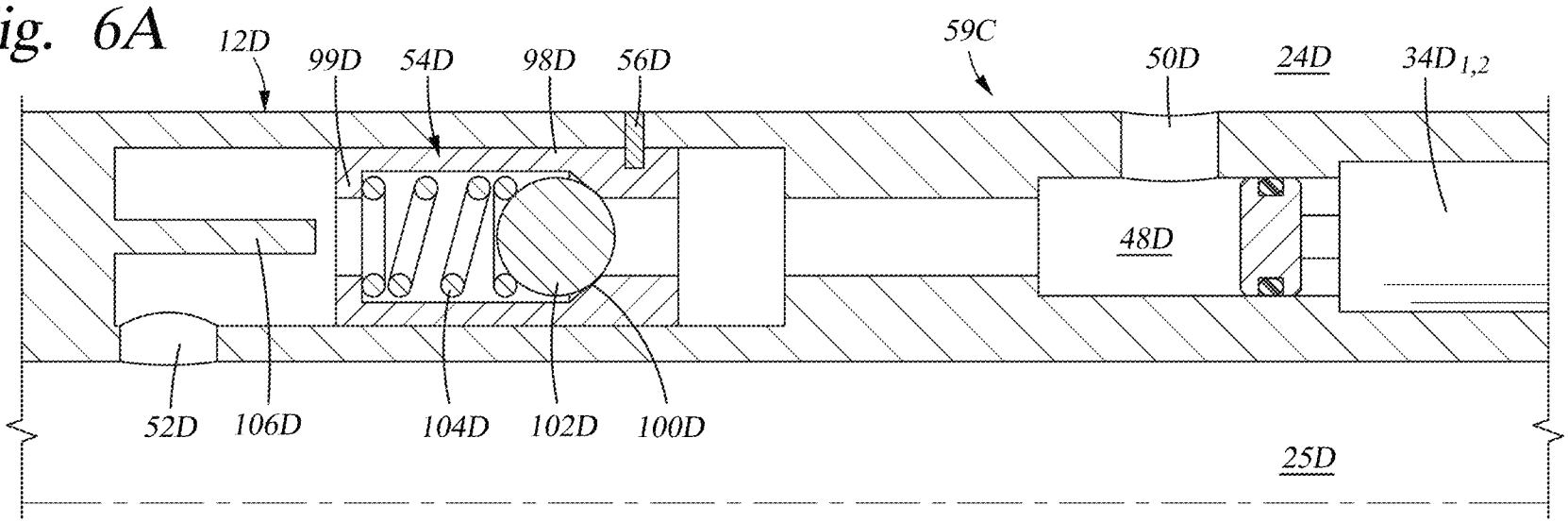
Figure 6B:
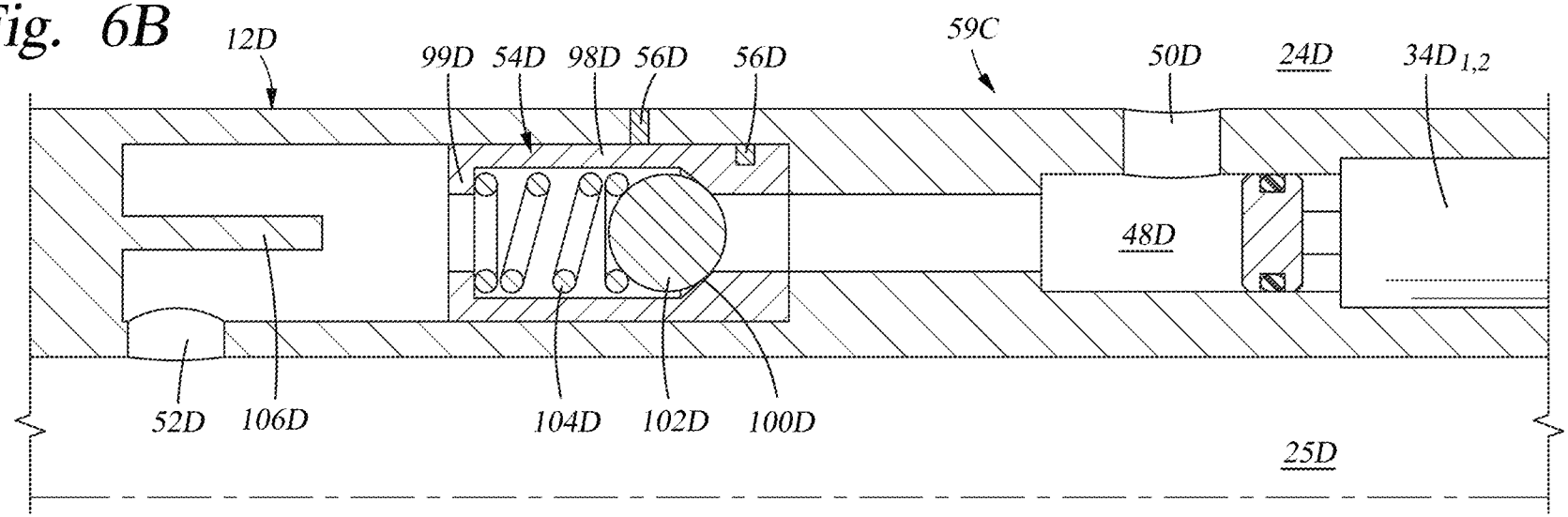
Figure 6C:
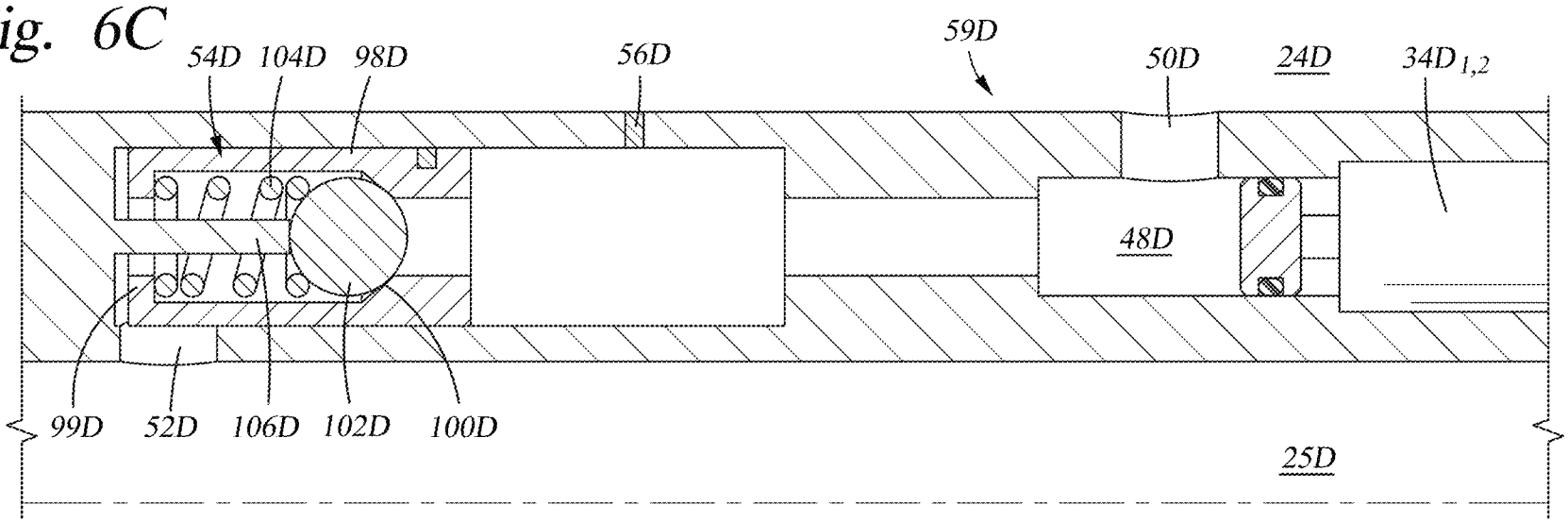
Figure 6D:
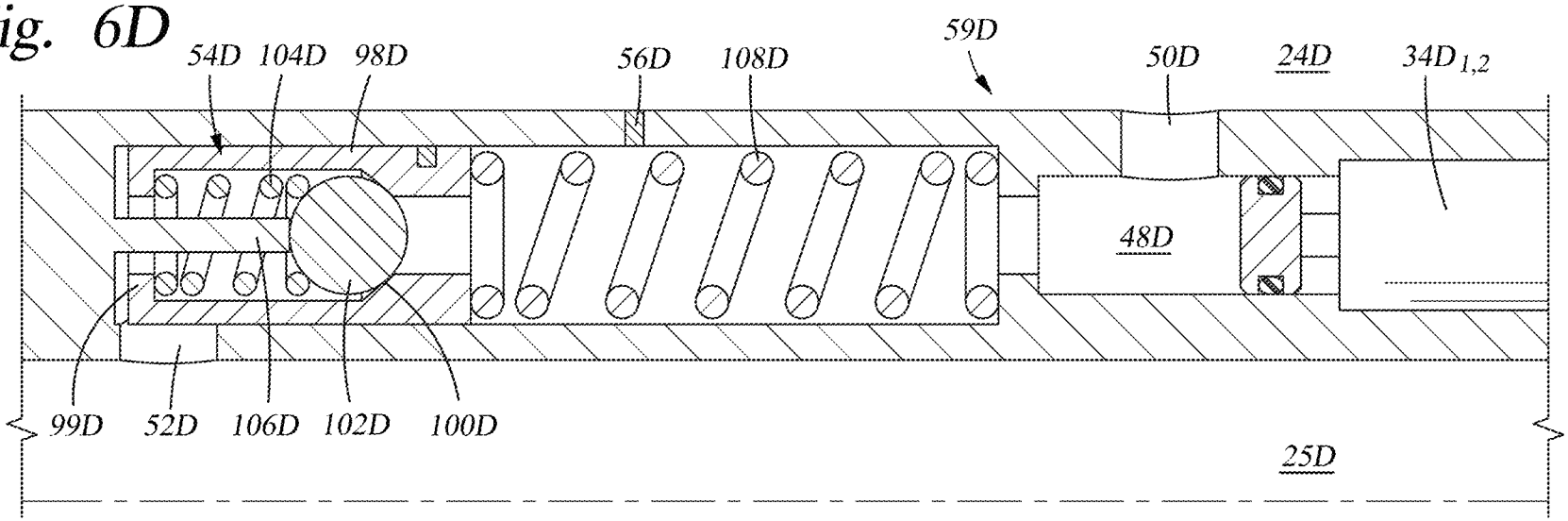

Referring now to FIGS. 6A through 6D, shown is another embodiment of a contingency system 59D in which the contingency valve 54D includes a carrier 98D with outer surfaces that are in close contact with oppositely facing surfaces of the plenum 48D. Carrier 98D is generally open within and shown having a lip 99D on one end that projects radially inward. On an end of carrier 98D opposite lip 99D is a frusto-conically shaped shoulder 100D that depends radially and obliquely inward, and forms a surface that faces in the direction of lip 99D. A valve member 102D is in abutting contact with shoulder 100D, and biased against shoulder 100D with a spring 104D. An end of spring 104D opposite valve member 102D is supported on lip 99D. A sealing interface is formed between valve member 102D and shoulder 100D which is maintained by a spring 104D. Shear pins 56D couple the carrier 98D to tubing 12D within plenum 48D. In a non-limiting example of operation, bore 25D is pressurized, which due to the sealing interface between valve member 102D and shoulder 100D, generates a force onto valve 54D towards SCFCV $\mathbf{34}_{1,2}$, similar to that described above with regard to FIG. 2D, fractures shear pin 56D and allows valve 56D to slide within plenum 48D in the direction of the force and towards the valve $\mathbf{34}_{1,2}$. Shown in FIG. 6C, is that pressure within the annulus 24D has increased above that of the bore 25D to urge the valve 54D away from valve $\mathbf{34}_{1,2}$. A pedestal 106D which is schematically illustrated as an axial member mounted within plenum 48D, abuts against an uphole side of valve member 102D, and forms a backstop to prevent further axial movement of the valve member 102D. In this location, the carrier 98D is a barrier to communication between side port 52D and plenum 48D, thereby also blocking flow between the annulus 24D and bore 25D. In an alternate embodiment of the system 59D, which is shown in FIG. 6D, a spring 108D is provided in the plenum 48D on a side of carrier 98D opposite spring 104D and which provides a redundant retaining force to maintain the seal between the ports 50D, 52D.

Figure 7:
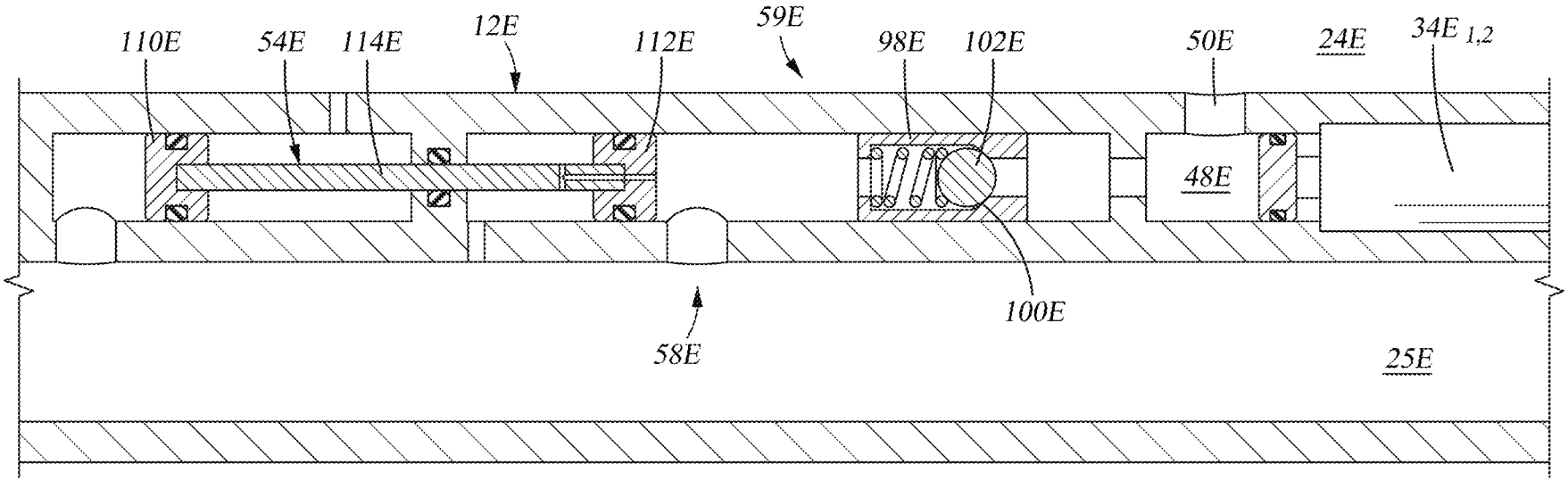
FIGS. 7-10 are side sectional views of alternate examples of contingency valves for use when the surface controlled flow control valves of FIGS. 1A and 1B are inoperable.
Figure 8:
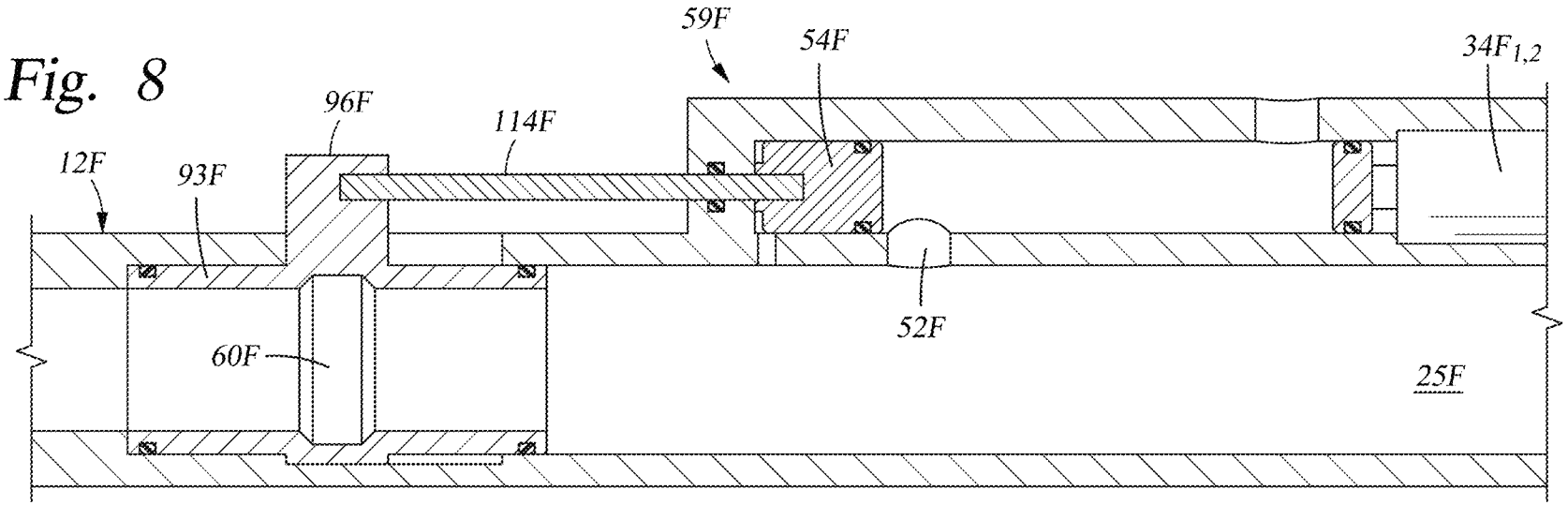
Figure 9:
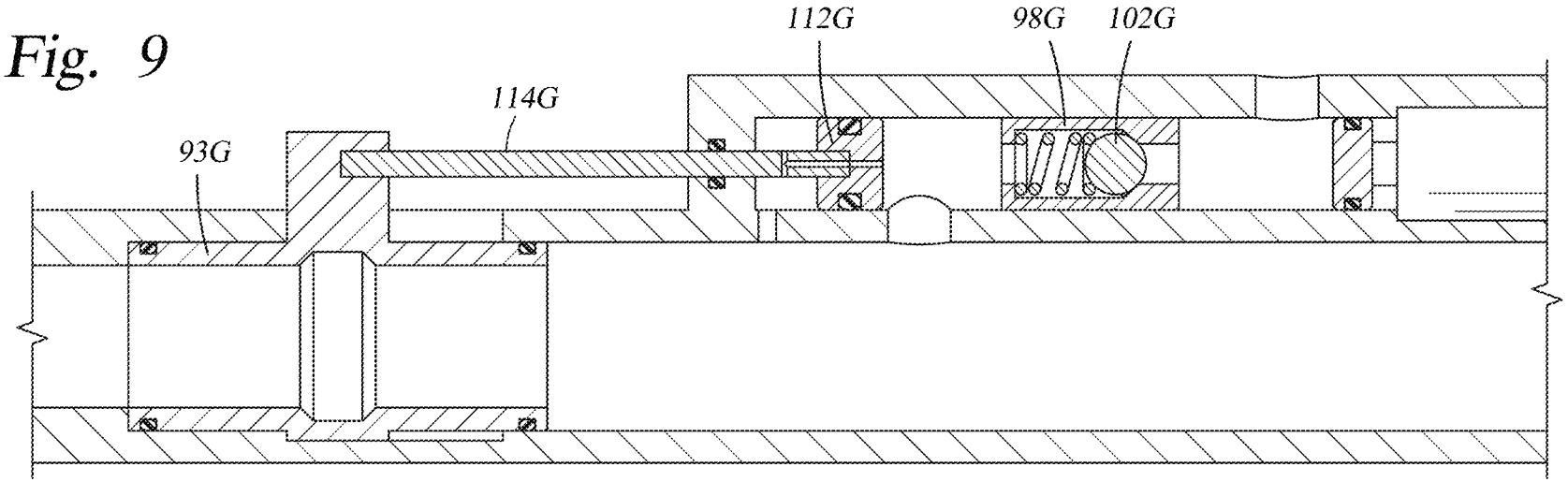
Figure 10:
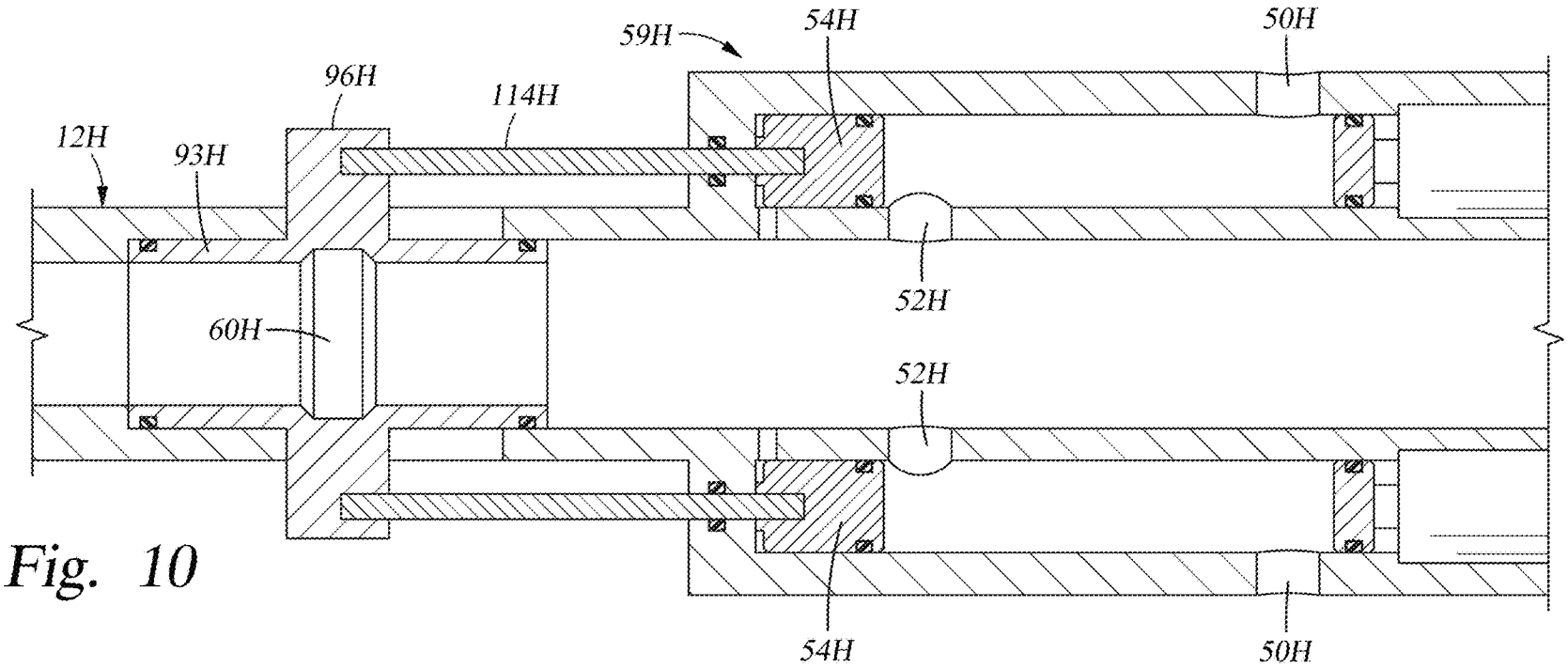

In FIGS. 7-10 are alternate embodiment of contingency systems. In FIG. 7 is a contingency system 59E in which the contingency valve 54E includes a piston 110E which is inside plenum 48E and proximate the contingency port 58E. Valve 54E includes a venting assembly 112E which connects to piston 110E via a shaft 114E. Venting assembly 112E provides an escape path for fluid trapped within plenum 48E between venting assembly 112E and valve $\mathbf{34}_{1,2}$. Optionally included in plenum 48D between venting assembly 112E and valve $\mathbf{34}_{1,2}$ is a carrier 98E shown having a shoulder 100E and valve member 102E. In this embodiment, the carrier 98E, shoulder 100E, and valve member 102E allow pressure to be built up in the tubing 12E without an intervention tool (not shown). Contingency system 59F of FIG. 8 is shown in side sectional view and which includes a sleeve 93F having an inner profile 60F for selective engagement by downhole tool (not shown) to move the sleeve 93F axially within bore 25F. Contingency valve 54F connects to the ridge 96F of sleeve 93F via shaft 114F shown extending axially along an outer surface of the tubing 12F. By engaging profile 60F with downhole tool to move sleeve towards valve $\mathbf{34}_{1,2}$ positions contingency valve 54F over side port 52F to address non-operational conditions of the valve $\mathbf{34}_{1,2}$. In FIG. 9, is a similar embodiment to that of FIGS. 7 and 8, which incorporates sleeve 93G and the venting assembly 112G on an end of shaft 114G and also the carrier 98G with valve member 102G. Referring now to FIG. 10 shown is another alternate embodiment of the contingency system 59H which similar to the system 59F of FIG. 8 and having multiple pistons 54H. System 59H includes a sleeve 93H that is axially slidable within production tubing 12H. In this example, multiple shafts 114H connect to the ridge 96H of sleeve 93H which on their opposing ends each connect to a piston 54H, with axial movement of sleeve 93H, each of the pistons 54H are axially slidable within a respective plenum 54H. A profile 60H within sleeve 93H is configured for engagement by a downhole tool (not shown) to put the valve 54H in the contingency position to block flow between inlet port 50H and side port 52H.

Figure 11:
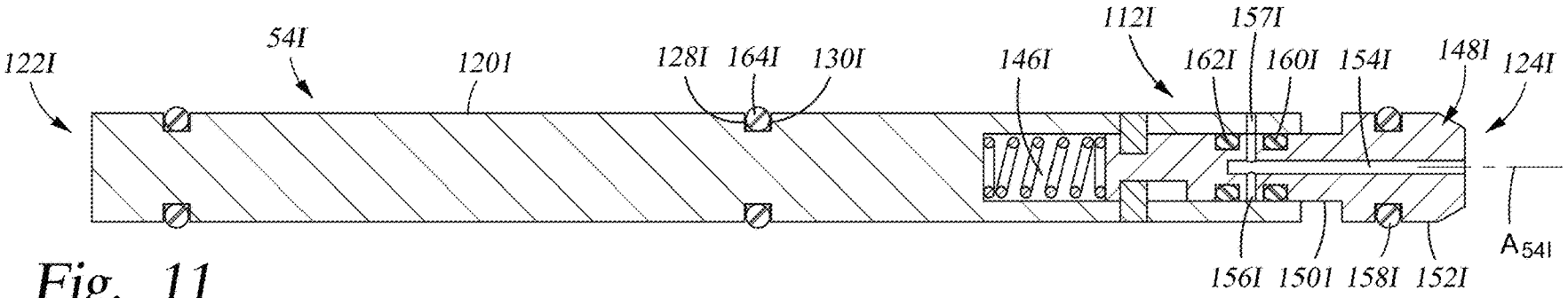
FIG. 11 is a side sectional view of an example of a contingency valve having a bleed port.

Shown in a side sectional view in FIG. 11 is another embodiment of a contingency valve 54I, which includes a body 120I having an uphole end 122I, a downhole end 124I, and venting assembly 112I formed on the downhole end 124I. This example of the venting assembly 112I includes a receptacle 146I shown formed into an end of body 120I opposite from uphole end 122I, in the example shown, receptacle 146I is a generally cylindrical void having an uphole end that is spaced away location downhole of uphole end 122I. A bleed plug 148I is shown having a shaft 150I that inserts into the receptacle 146I. Bleed plug 148I includes a nose portion 152I shown with an outer diameter exceeding shaft 150I, nose portion 152I attaches to an end of shaft 150I outside of receptacle 146I. A passage 154I extends axially through the bleed plug 148I and along a path substantially parallel with axis $A_{54I}$ of valve 54I. Inside shaft 150I are ducts 156I that project radially outward from passage 154I, in the example of FIG. 11 ducts 156I are registered with bleed ports 157I that extend radially from the receptacle 146I to an outer surface of body 120I. An O-ring 158I circumscribes an outer surface of the nose portion 152I, and O-rings 1601, 1621 circumscribe shaft 150I on opposing sides of the ducts 156I. O-rings 164I are also shown circumscribing body 120I at an axial location between shoulders 128I, 130I.

Figure 12A:
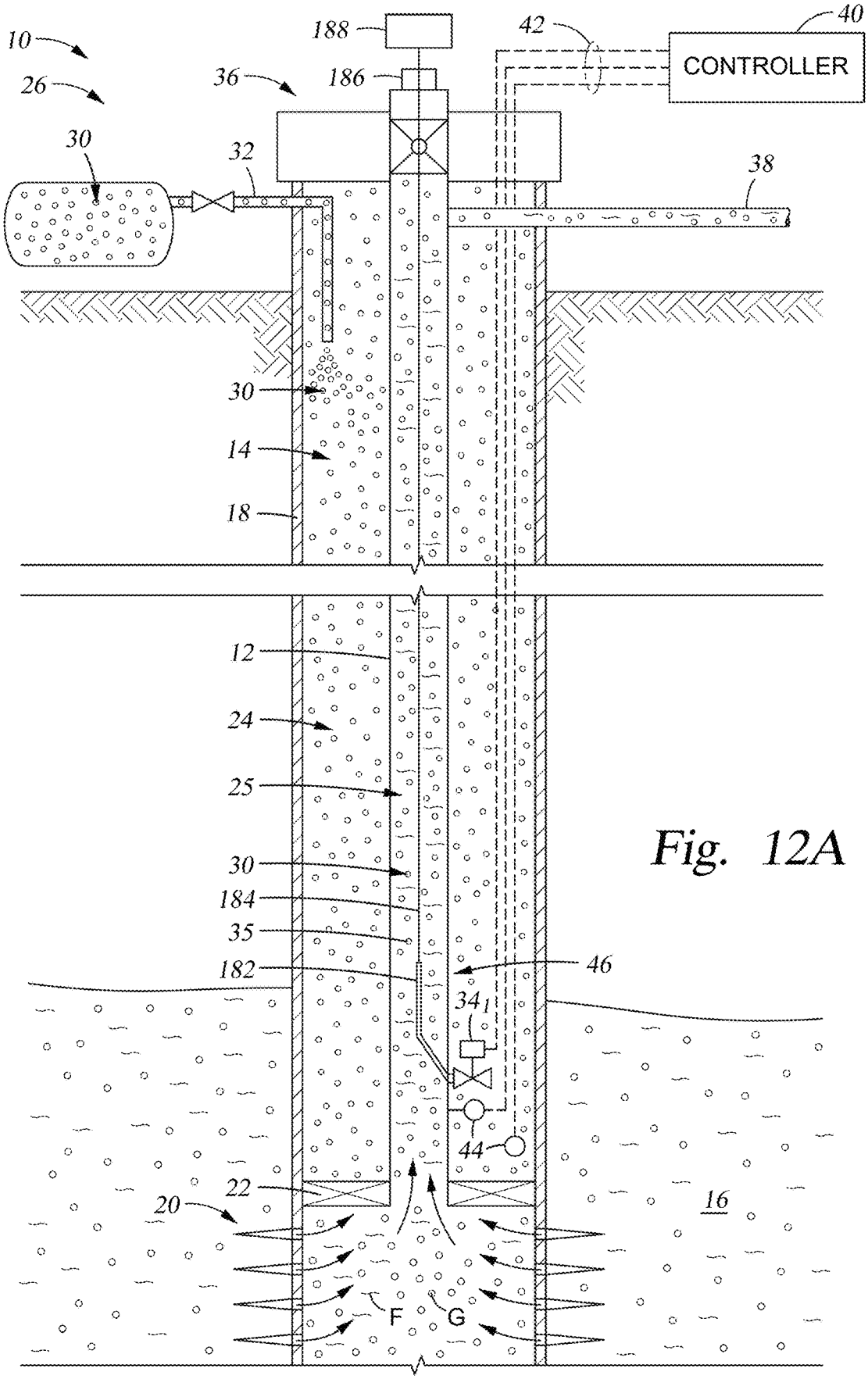
FIG. 12A is a side partial sectional view of an example of conducting a contingency operation on the surface controlled flow control valve of FIG. 1A.

Referring now to FIG. 12A, shown is an example of operation in which the SCGLV 34 is in a non-operational state, and unable to inject lift gas 30 from the annulus 24 into the production tubing 12. In an embodiment, the non-operational state of the SCGLV 34 is detected by monitoring output signals from the sensors 42 or other sensors (not shown), or diagnostic software within controller 40. In one example of remediating the non-operational state of the SCGLV $\mathbf{34}_1$ (i.e., a contingency operation), contingency valve 54 of FIG. 11 is installed in the eccentric portion 46 and adjacent SCGLV $\mathbf{34}_1$. In this example, a kickover tool 182 is shown deployed within the production tubing 12 and suspended on a line 184. An optional lubricator 136 is mounted on an upper end of wellhead assembly 36, which provides pressure control for the line 184. Examples of the line 184 include wireline, slickline, coiled tubing, braided wire, and any other means for deploying a device within a well. A deployment means 138 is schematically shown attached to an end of line opposite kickover tool 182; examples of deployment means 138 include an injector, such as when dealing with coiled tubing, or a winch of when dealing with wireline or slickline. Further in the example, the kickover tool 182 is shown deployed at a depth adjacent to the eccentric portion 46 and for handling contingency valve 54. After installation of the contingency valve 54, lift gas 30 is selectively injected into the bore 25 by pressurizing lift gas 30 in annulus 24.

Figure 12B:
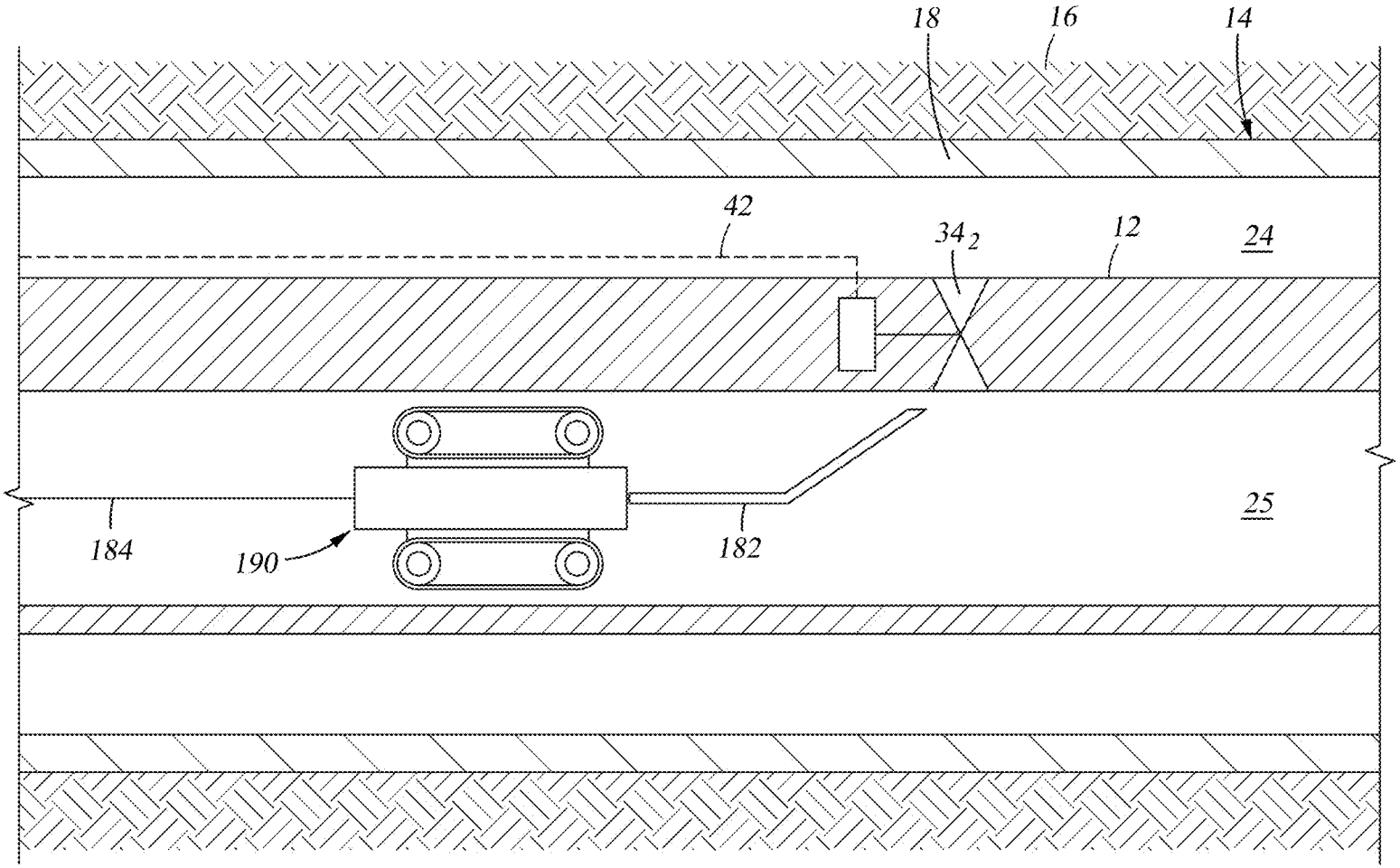
FIG. 12B is a side partial sectional view of an example of conducting a contingency operation on the surface controlled flow control valve of FIG. 1B.

Shown in a side sectional view FIG. 12B is an example of a contingent operation on an SCFCV $\mathbf{34}_2$ disposed in a deviated portion of the wellbore 14. Here the kickover tool 182 is shown mounted on a wellbore tractor 190, which is tethered on its opposite end with a line 184, which is used to lower tractor 190 downhole, and also provides a medium for communications, such as for providing command to the tractor 190. Similar to a contingency operation conducted on the surface controlled gas lift valve $\mathbf{34}_1$, the kickover tool 182 is used for conducting the operations of either removing valve $\mathbf{34}_2$ or optionally conducting the shifter functions described above.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. The present disclosure is not limited to the use of a kickover tool 182, but includes other types of tools, such as intervention tools, and any other type of tool deployable into a wellbore for servicing devices downhole. These and other similar modifications will readily suggest themselves to those skilled in the art, and are intended to be encompassed within the spirit of the present invention disclosed herein and the scope of the appended claims.

What is claimed is:

1. A contingency method in a wellbore comprising:

identifying when a surface controlled flow control valve ("SCFCV") is in a non-operational state, the SCFCV coupled to production tubing in the wellbore and having a valve member that is selectively moveable in and out of a flow path that extends between an annulus circumscribing the production tubing and a bore in the production tubing, the valve member being out of the flow path when the SCFCV is in the non-operational state, the flow path intersecting a plenum in a sidewall of the production tubing, a contingency valve disposed in the plenum and spaced away from the flow path;

when the SCFCV is in a non-operational state, urging the contingency valve into the flow path to block fluid communication along the flow path; and retaining the contingency valve in the flow path.

2. The method of claim 1, wherein the contingency valve is urged into the flow path by pressurizing the plenum on a side of the contingency valve opposite the SCFCV.

3. The method of claim 2, wherein pressurizing the plenum on a side of the contingency valve opposite the SCFCV comprises pumping fluid from within a downhole tool deployed in the wellbore and into a contingency port formed through an inner sidewall of the bore in the production tubing.

4. The method of claim 3, wherein the contingency port being in communication with the plenum and wherein communication between the contingency port and the plenum is through a fluid line that extends axially along the production tubing.

5. The method of claim 3, wherein the step of pressurizing further comprises isolating a bore inside the tubing from the pressurized fluid by sealing around the contingency port.

6. The method of claim 5, wherein the contingency port being in communication with the plenum and wherein communication between the contingency port and the plenum is through a fluid line that extends axially along the production tubing.

7. The method of claim 1, wherein the SCFCV comprises a valve that is selected from the group consisting of an interval control valve, an inflow control device, and a gas lift valve.

8. The method of claim 1, further comprising monitoring the operational condition of the SCFCV.

9. A contingency system for use in a wellbore comprising:

a plenum formed in a sidewall of production tubing disposed in the wellbore and having a surface controlled flow control valve ("SCFCV") coupled to the production tubing, the SCFCV having a valve member that is selectively moveable in and out of a flow path that extends between an annulus circumscribing the production tubing and a bore inside the production robing;

a contingency valve disposed in the plenum; and an activation portion of the plenum on a side of the contingency valve opposite the SCFCV, which is configured to be selectively sealed, so that when the activation portion is pressurized, the contingency valve is moved into the flow path to define a barrier to fluid communication between the plenum and the bore;

a contingency port on a sidewall of the production tubing in communication with the activation portion; and a downhole tool deployable into the bore, the downhole tool comprising a pressurized fluid source and a discharge line, the discharge line in communication with the pressurized fluid source and in selective communication with the contingency port.

10. The system of claim 9, wherein the pressurized fluid source comprises a fluid reservoir and a pump having an inlet connected to the fluid reservoir.

11. The system of claim 9, wherein the activation portion comprises a fluid line that extends axially along a length of the production tubing between the contingency port and the contingency valve.

12. The system of claim 9, wherein the SCFCV comprises a valve selected from the group consisting of an interval control valve, an inflow control device, and a gas lift valve.

* * * * *